US006168461B1

(12) United States Patent
Chang

(10) Patent No.: US 6,168,461 B1
(45) Date of Patent: Jan. 2, 2001

(54) MODULE JACK ARRANGEMENT

(75) Inventor: Chih-Kai Chang, Taipei Hsien (TW)

(73) Assignee: Teckon Electronics Corp., Taipei Hsien (TW)

( * ) Notice: Under 35 U.S.C. 154(b), the term of this patent shall be extended for 0 days.

(21) Appl. No.: 09/467,010

(22) Filed: Dec. 20, 1999

(51) Int. Cl.[7] ..... H01R 13/60
(52) U.S. Cl. ..... 439/540.1
(58) Field of Search ..... 439/540.1, 701, 439/717, 676, 715, 541.5

(56) References Cited

U.S. PATENT DOCUMENTS 3,771,104 * 11/1973 Clark ..... 339/31 R
4,406,509 * 9/1983 Jagen ..... 339/91 R
4,425,018 * 1/1984 Stenz ..... 39/198 GA
4,469,393 * 9/1984 Chewning, Jr. et al. ..... 439/198 GA
4,820,169 * 4/1989 Weber et al. ..... 439/65
5,425,660 * 6/1995 Weikle ..... 439/676
5,443,404 * 8/1995 Matsuoka ..... 439/717
5,951,306 * 9/1999 Millhimes ..... 439/79
6,080,011 * 6/2000 Tsao et al. ..... 439/541.5
6,083,056 * 7/2000 Okabe et al. ..... 439/701

* cited by examiner

*Primary Examiner*—Gary F. Paumen
*Assistant Examiner*—Phuongchi Nguyen
(74) *Attorney, Agent, or Firm*—Robert E. Bushnell, Esq.

(57) ABSTRACT

A module jack arrangement, which includes multiple module jacks coupled into a row, and at least one clip respectively installed in each two adjacent module jacks to secure the module jacks in position, each module jack including a housing, a terminal holder fastened to the housing and holding a set of terminals, wherein the housing has two coupling tongues and two coupling flanges disposed at two opposite sides at different elevations for enabling the housings two module jacks to be coupled together, and two coupling grooves at two opposite sides for receiving the respective clip; the terminal holder has two vertical coupling flanges bilaterally disposed in reversed directions for enabling the terminal holder of one module jack to be coupled to the terminal holder of another, and a hooked flange for engagement with a hooked flange in the housing of the respective module jack.

6 Claims, 6 Drawing Sheets

MODULE JACK ARRANGEMENT

BACKGROUND OF THE INVENTION

The present invention relates to a module jack, and more particularly to a module jack, which enables the user to connect a plurality of module jacks positively in a row without the use of a tool or any fastening elements.

FIGS. 6 and 7 show a module jack for use in a printed circuit board to receive a module plug for electric signal transmission. This structure of module jack must be individually installed. When multiple module jacks are used and arranged together, fastening means must be used to secure the module jacks in position. In making an electric connector device having multiple module jacks, the manufacturing procedure is complicated, and the manufacturing cost is high.

SUMMARY OF THE INVENTION

The present invention has been accomplished under the circumstances in view. According to the present invention, multiple coupling jacks can easily be coupled to one another, forming a row of module jacks. A clip is used to secure each two adjacent module jacks together. A module jack according to the present invention comprises a housing, a terminal holder having a flat horizontal base fastened to the housing and a vertical block disposed outside the housing, and a plurality of terminals installed in the terminal holder. The housing comprises two longitudinal coupling tongues and two locating flanges respectively disposed at two opposite lateral sides at different elevations for enabling the housings two module jacks to be coupled together, and two coupling grooves at two opposite sides for receiving the respective clip. The terminal holder comprises two vertical coupling flanges bilaterally disposed in reversed directions for enabling the terminal holder of one module jack to be coupled to the terminal holder of another, and a hooked flange for engagement with a hooked flange in the housing of the respective module jack.

DETAILED DESCRIPTION OF THE PREFERRED EMBODIMENT

Figure 1:
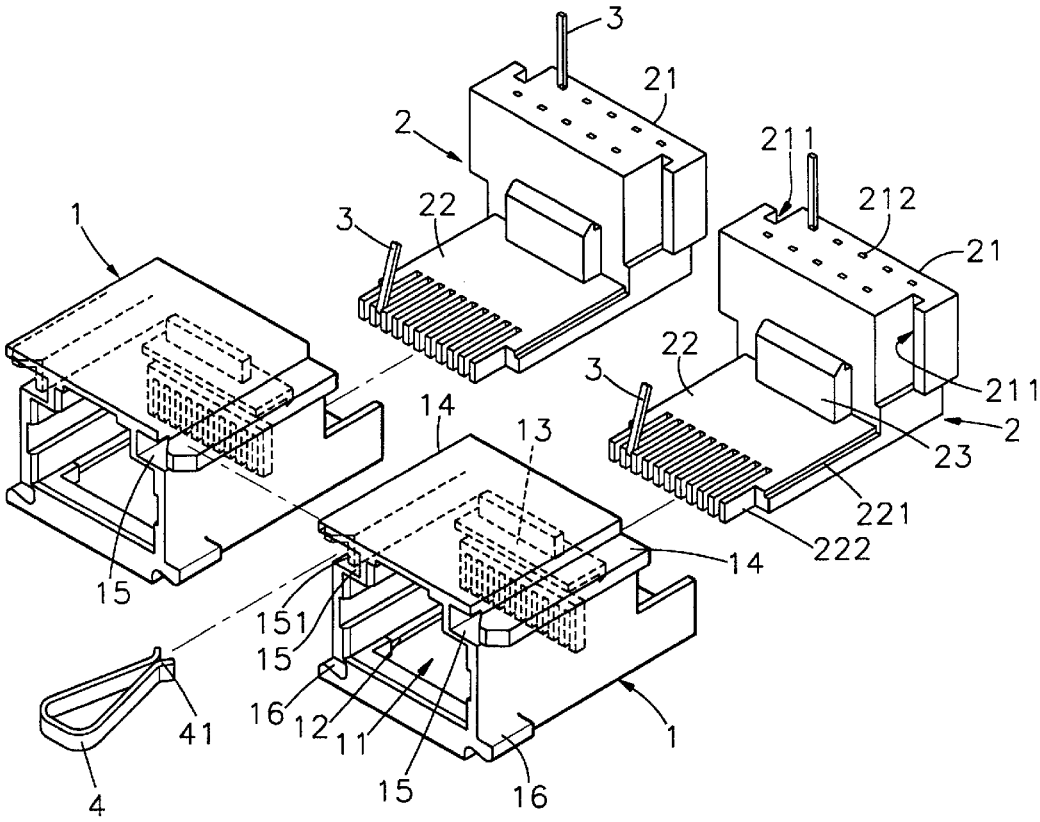
FIG. 1 is an exploded view of two module jacks according to the present invention.

Referring to Figures from 1 through 3, two module jacks are fastened together by a clip 4. Each module jack comprises a housing 1, a terminal holder 2, and a set of terminals 3.

The housing 1 comprises a receiving chamber 11 for receiving a module plug, two sliding grooves 12 bilaterally longitudinally disposed in the receiving chamber 11 at the bottom side, a hooked flange 13 transversely disposed in the receiving chamber 11 at the top side, two longitudinal coupling tongues 14 respectively disposed at two opposite lateral side walls thereof on the outside at different elevations near the top, two longitudinal coupling grooves 15 respectively defined in the longitudinal coupling tongues 14, two beveled guide edges 151 respectively disposed in front of the coupling grooves 15, and two locating flanges 16 respectively disposed at the two opposite lateral side walls on the outside at different elevations near the bottom. The locating flanges 16 each have a top surface smoothly curved upwardly outwards. The longitudinal coupling tongues 14 and the longitudinal coupling grooves 15 are so arranged that the housings 1 of the two module jacks can be fastened to each other side by side by coupling the longitudinal coupling tongue 14 at one side of one housing 1 to the longitudinal coupling groove 15 at the adjacent side of the other.

The terminal holder 2 comprises a flat horizontal base 22, a vertical block 21 perpendicularly raised from one end, namely, the rear end of the flat horizontal base 22, a hooked flange 23 raised from the flat horizontal base 22 and formed integral with the front side wall of the vertical block 21, two vertically extended coupling flanges 211 respectively disposed at two opposite vertical lateral side walls of the vertical block 21 and arranged in reversed directions, a plurality of terminal slots 212 respectively extended through the vertical block 21 and the flat horizontal base 22 for the installation of the respective terminals 3, two sliding rails 221 provided at two opposite lateral sides of the flat horizontal base 22 corresponding to the sliding grooves 12 in the receiving chamber 11 inside the housing 1, and a row of partition strips 222 forwardly extended from the front side of the flat horizontal base 22 for separating the terminals 3 from one another. The terminals 3 each have a front end extended out of the flat horizontal base 22 of the terminal holder 2 and turned upwardly obliquely backwards, and a rear end extended out of the top side of the vertical block 21 of the terminal holder 2.

Figure 5:
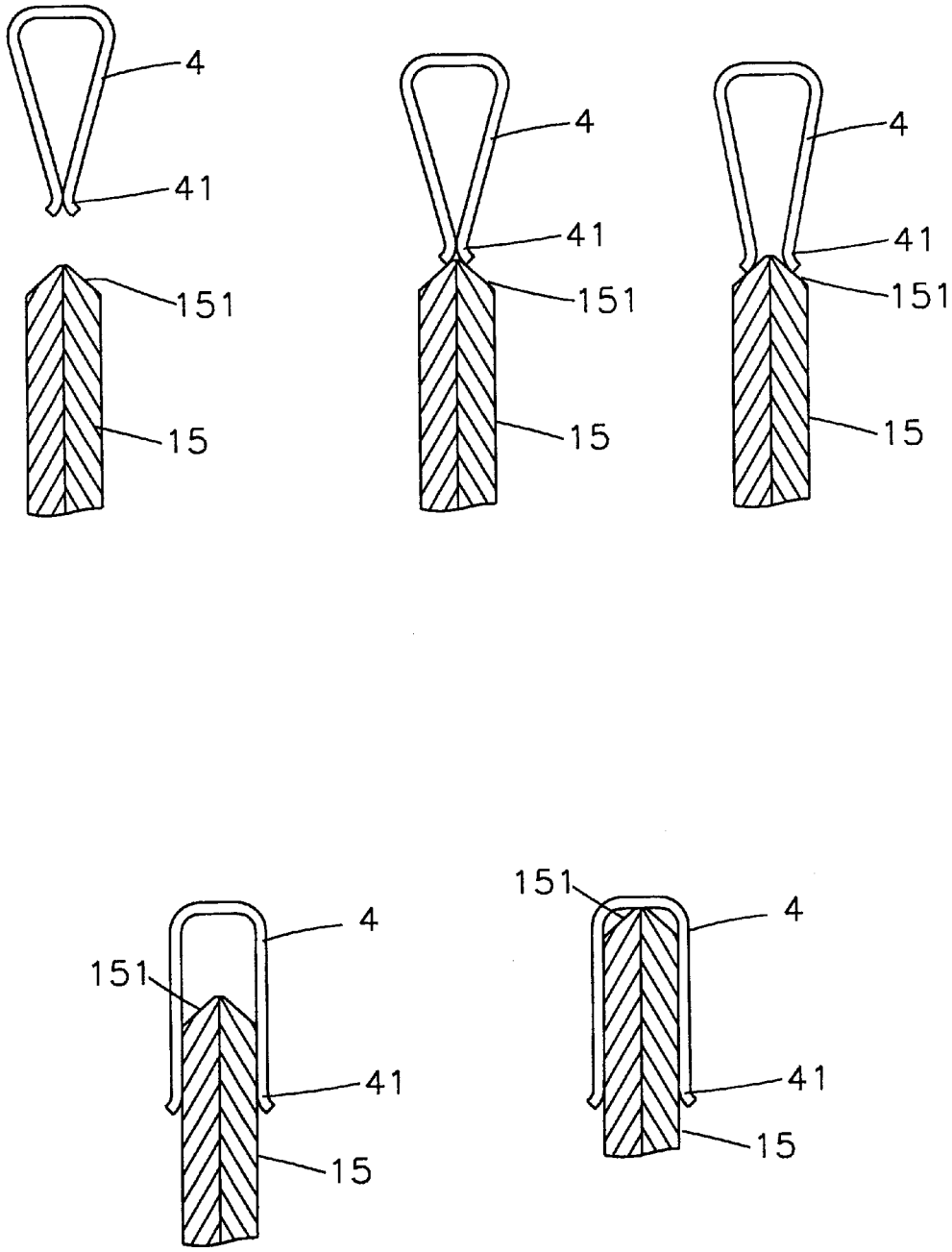
FIG. 5 illustrates the continuous action of the installation of the clamp according to the present invention.
Figure 6:
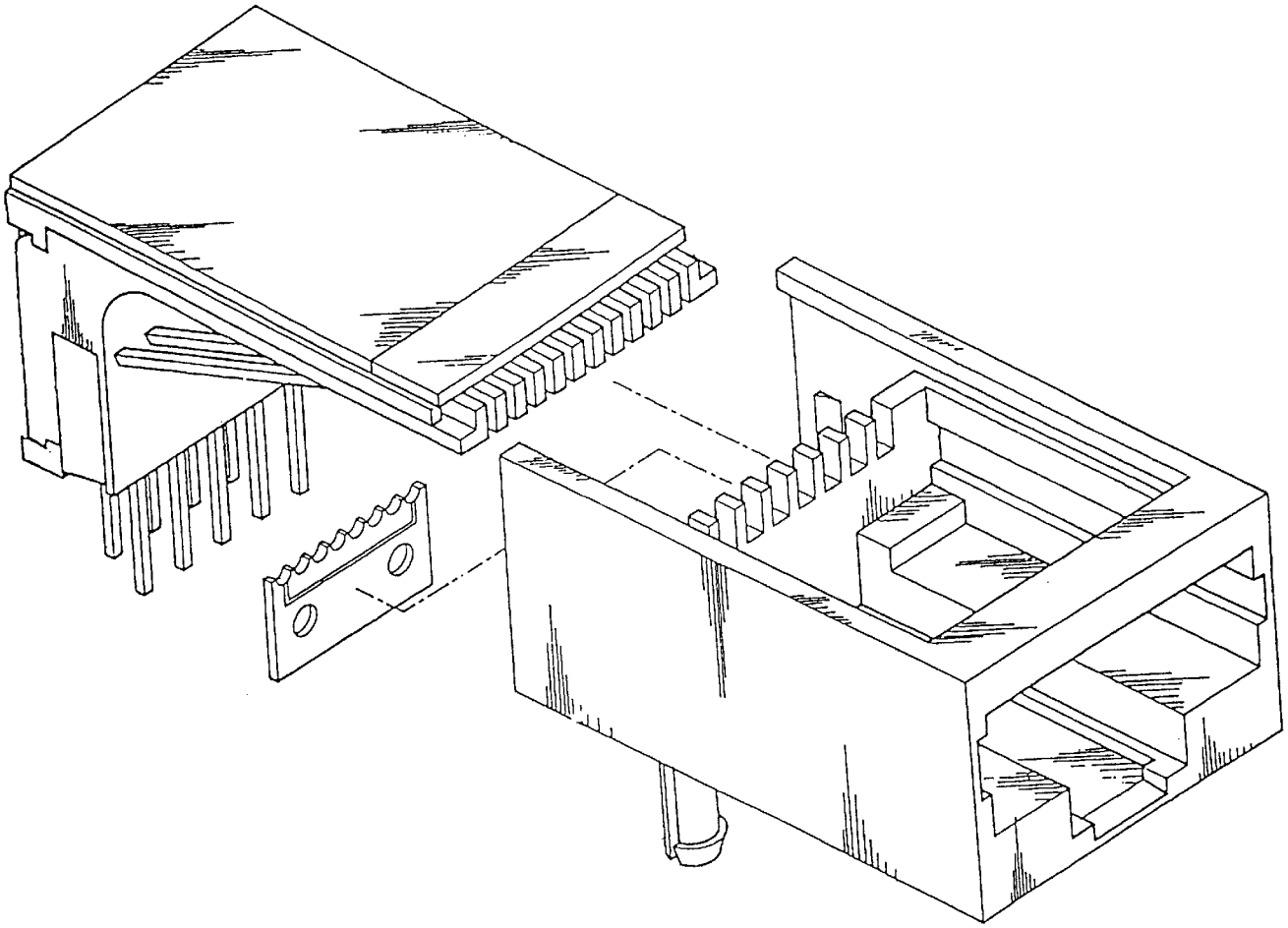
PRIOR ART FIG. 6
FIG. 6 is an exploded view of a module jack according to the prior art.
Figure 7:
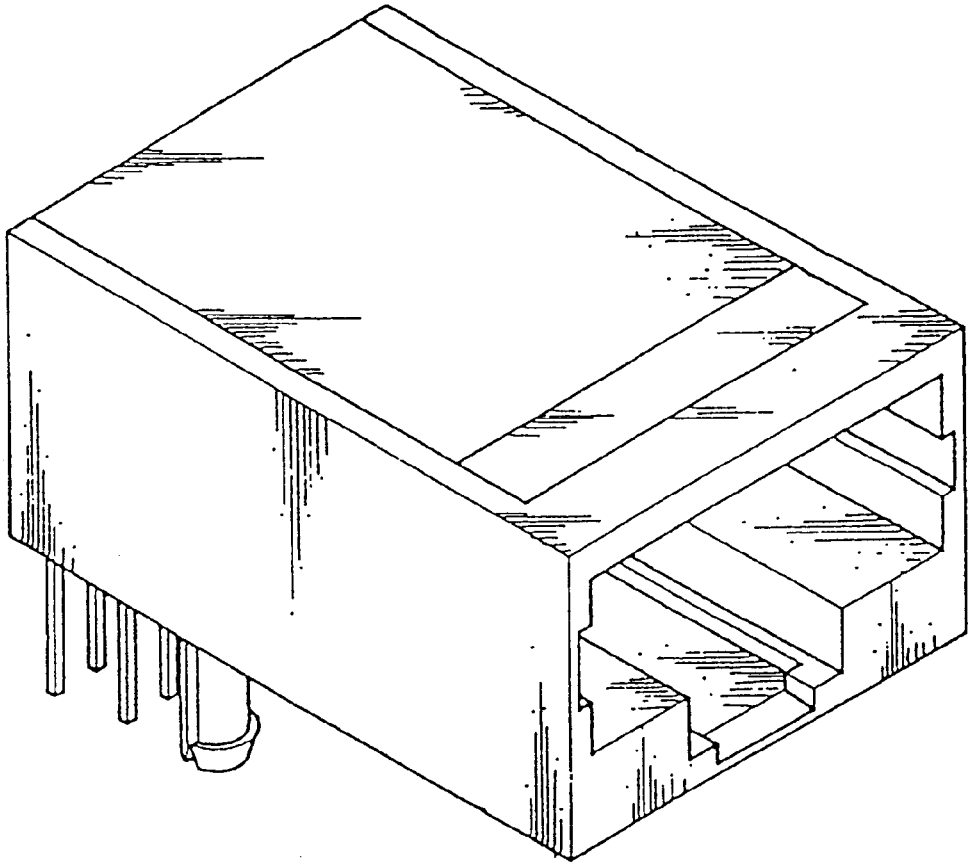
PRIOR ART FIG. 7
FIG. 7 is an assembly of the module jack shown in FIG. 6.

The clip 4 is made of a spring strip bent into shape, having two opposite ends disposed in contact with each other and then terminating in a respective tip 41 respectively curved outwards in reversed directions. The outwardly curved tips 41 enable the clip 4 to be smoothly guided by the corresponding beveled guide edge 151 at the housing 1 of each module jack into the corresponding coupling groove 15 in one coupling tongue 14 at each module jack (see also FIG. 5).

Figure 2:
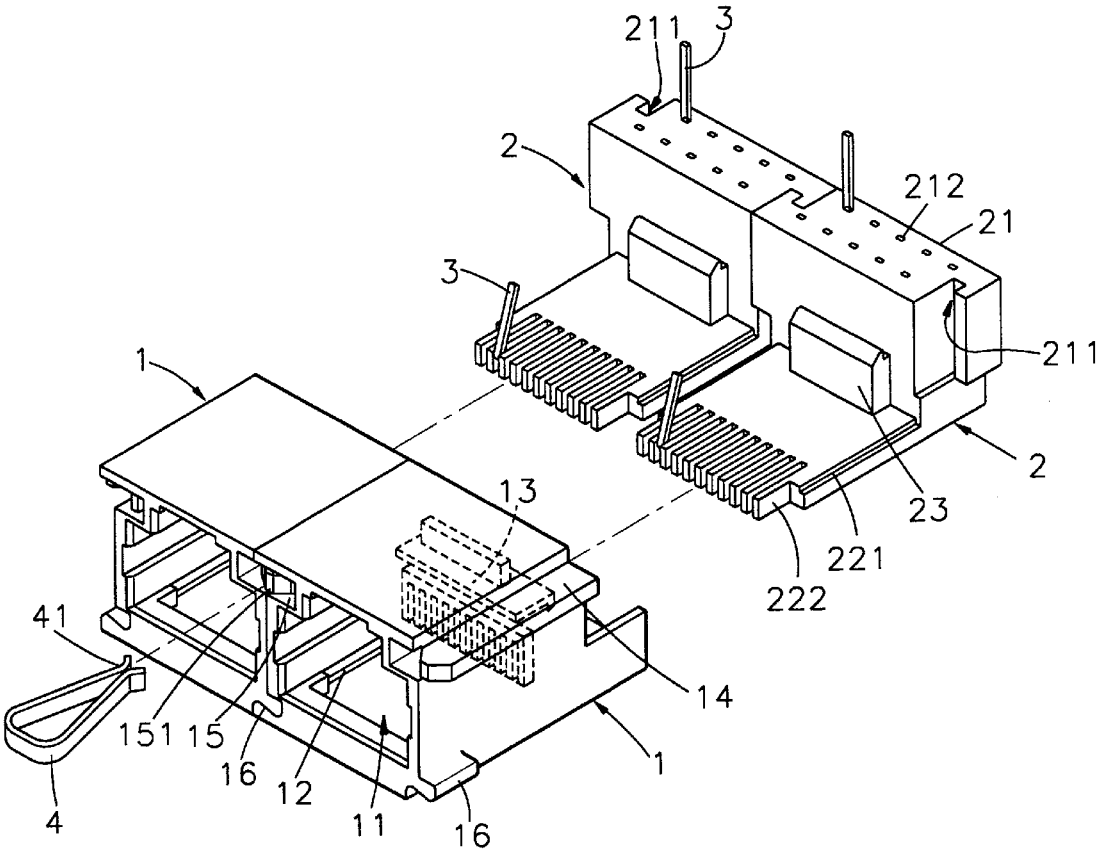
FIG. 2 is an assembly view of FIG. 1 before the installation of the terminal holders in the respective housings.
Figure 3:
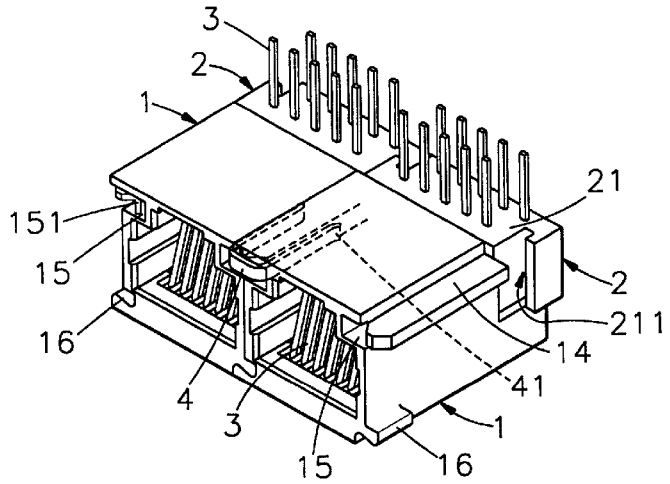
FIG. 3 is a perspective view showing the two module jacks of FIG. 1 well assembled.
Figure 4:
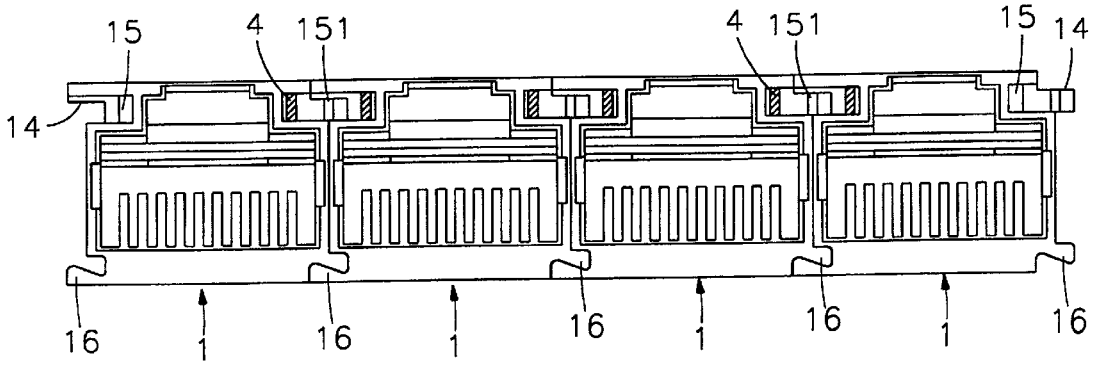
FIG. 4 is a front view showing multiple module jacks connected in a row.

Referring to Figures from 1 through 5, the coupling tongue 14 and locating flange 16 at one side of the housing 1 of one module jack are respectively forced into engagement with the coupling tongue 14 and locating flange 16 at one side of the housing 1 of the other module jack (see FIG. 2), and then the outwardly curved tips 41 of the clip 4 are respectively aimed at the corresponding beveled guide edge 151 at the housing 1 of each module jack and then forced into the corresponding coupling grooves 15 in the two module jacks (see also FIG. 5) to secure the two housings 1 firmly together, and then the sliding rails 221 of the terminal holder 2 of one module jack are respectively aimed at the sliding grooves 12 in the corresponding housing 1, then the flat horizontal base 22 of the terminal holder 2 is inserted into the receiving chamber 11 in the corresponding housing 1. When inserted, the hooked flange 23 at the terminal holder 2 of one module jack is forced into engagement with the hooked flange 13 in the corresponding housing 1, and therefore the terminal holder 2 and the housing 1 of the same module jack are firmly secured together. After assembly of one module jack, the terminal holder 2 of the second module jack is fastened to the corresponding housing 1. When installed, the coupling flange 211 at one side of the vertical block 21 of the terminal holder 2 of the second module jack is forced into engagement with the coupling flange 211 at one side of the vertical block 21 of the terminal holder 2 of the first module jack, and therefore the two module jacks are firmly secured together (see FIG. 3). By means of the aforesaid mounting procedure, multiple module jacks can be connected in a row as shown in FIG. 4.

When the housings 1 of two module jacks are attached together, the longitudinal coupling tongue 14 and locating flange 16 at one side of the housing 1 of one module jack are respectively pressed on the longitudinal coupling tongue 14 and locating flange 16 at one side of the housing 1 of the other module jack, and the clip 4 is fastened to the longitudinal coupling groove 15 on the housing 1 of each module jack, therefore the two housings 1 are positively secured together. Further, when the terminal holders 2 of two module jacks are respectively inserted into the respective housings 1, the hooked flange 23 of the terminal holder 2 of each module jack is respectively hooked up with the hooked flange 13 in the respective housing 1, and the coupling flange 211 at one side of the vertical block 21 of the terminal holder 2 of one module jack is engaged with the coupling flange 211 at the other module jack, therefore the two module jacks are positively secured together.

Because the housing 1 and the terminal holder 2 are respectively modularized, the fabrication of the module jack is simple and inexpensive.

While only one embodiment of the present invention has been shown and described, it will be understood that various modifications and changes could be made thereunto without departing from the spirit and scope of the invention disclosed.

What the invention claimed is:

1. A module jack arrangement comprising a plurality of module jacks arranged in a row, and at least one clip fastened to two adjacent module jacks to secure said module jacks in a row, wherein said module jacks each comprise a housing, a terminal holder mounted in said housing, and a plurality of terminals installed in said terminal holder, said housing comprising a receiving chamber for receiving a module plug, two longitudinal coupling tongues respectively disposed at two opposite lateral side walls thereof on the outside at different elevations near a top side thereof, two longitudinal coupling grooves respectively defined in said longitudinal coupling tongues, and two locating flanges respectively disposed at the two opposite lateral side walls on the outside at different elevations near a bottom side thereof, said longitudinal coupling tongues and said locating flanges being so arranged that the longitudinal coupling tongue and locating flange at one side of the housing of a first module jack are respectively pressed on the longitudinal coupling tongue and locating flange at one side of the housing of a second module jack when two module jacks are attached together side by side, said terminal holder comprising a flat horizontal base inserted into the receiving chamber in the housing of the respective module jack, a vertical block perpendicularly raised from a rear end of said flat horizontal base, two vertically extended coupling flanges respectively disposed at two opposite vertical lateral side walls of said vertical block and arranged in reversed directions such that the coupling flange at one side of the vertical block of the terminal holder of one module jack is engaged with the coupling flange at one side of the vertical block of the terminal holder of the other module jack when two module jacks are fastened together, a plurality of terminal slots respectively extended through said vertical block and said flat horizontal base, and a plurality of terminals respectively installed in said terminal slots; said at least one clip each is comprised of a curved spring strip having two opposite ends disposed in contact with each other and terminating in a respective tip respectively curved outwards in reversed directions for engaging into the coupling groove in one coupling tongue at one side of the housing of each of two adjacent module jacks.

2. The module jack arrangement of claim 1 wherein said housing comprises two beveled guide edges respectively disposed in front of the coupling grooves thereof for guiding the corresponding clip into position.

3. The module jack arrangement of claim 1 wherein said housing comprises two longitudinal sliding grooves bilaterally disposed inside said receiving chamber, and a hooked flange transversely provided inside said receiving chamber at a top side; said terminal holder comprises two sliding rails provided at two opposite lateral sides of said flat horizontal base and respectively inserted into the sliding grooves in said housing, and a hooked flange raised from said flat horizontal base and formed integral with a front side wall of said vertical block and forced into engagement with the hooked flange in said housing.

4. The module jack arrangement of claim 1 wherein said locating flanges of said housing each have a top surface smoothly curved upwardly outwards.

5. The module jack arrangement of claim 1 wherein said terminal holder comprises a plurality of partition strips forwardly extended from a front side of said flat horizontal base to separate said terminals from one another.

6. The module jack arrangement of claim 1 wherein said terminals each having a front end extended out of the flat horizontal base of said terminal holder and turned upwardly obliquely backwards.

* * * * *